US007383174B2

(12) United States Patent
Paulin

(10) Patent No.: US 7,383,174 B2
(45) Date of Patent: Jun. 3, 2008

(54) METHOD FOR GENERATING AND ASSIGNING IDENTIFYING TAGS TO SOUND FILES

(76) Inventor: Matthew A. Paulin, 741 N. 76th St., Seattle, WA (US) 98103

( * ) Notice: Subject to any disclaimer, the term of this patent is extended or adjusted under 35 U.S.C. 154(b) by 809 days.

(21) Appl. No.: 10/679,536

(22) Filed: Oct. 3, 2003

(65) Prior Publication Data

US 2005/0075862 A1 Apr. 7, 2005

(51) Int. Cl.
*G10L 19/00* (2006.01)

(52) U.S. Cl. ..... 704/201; 704/203; 704/7; 707/3

(58) Field of Classification Search ..... 704/7, 704/201, 203; 707/3
See application file for complete search history.

(56) References Cited

U.S. PATENT DOCUMENTS

2002/0083060 A1* 6/2002 Wang et al. ..... 707/10
2003/0023421 A1* 1/2003 Finn et al. ..... 704/1
2004/0215447 A1* 10/2004 Sundareson ..... 704/200.1
2006/0122839 A1* 6/2006 Wang et al. ..... 704/273

* cited by examiner

*Primary Examiner*—Daniel Abebe
(74) *Attorney, Agent, or Firm*—Gerhard P. Shipley

(57) ABSTRACT

A method of generating and assigning identifying tags to sound files according to standardized criteria that result in substantially unique tags while minimizing differences in sound files that are ideally identical. A number of points in the sound file's unique frequency domain are chosen to create a position in N dimensional space, and this position is used to determine similarities and differences among sound files.

6 Claims, 1 Drawing Sheet

Figures 1, 2:
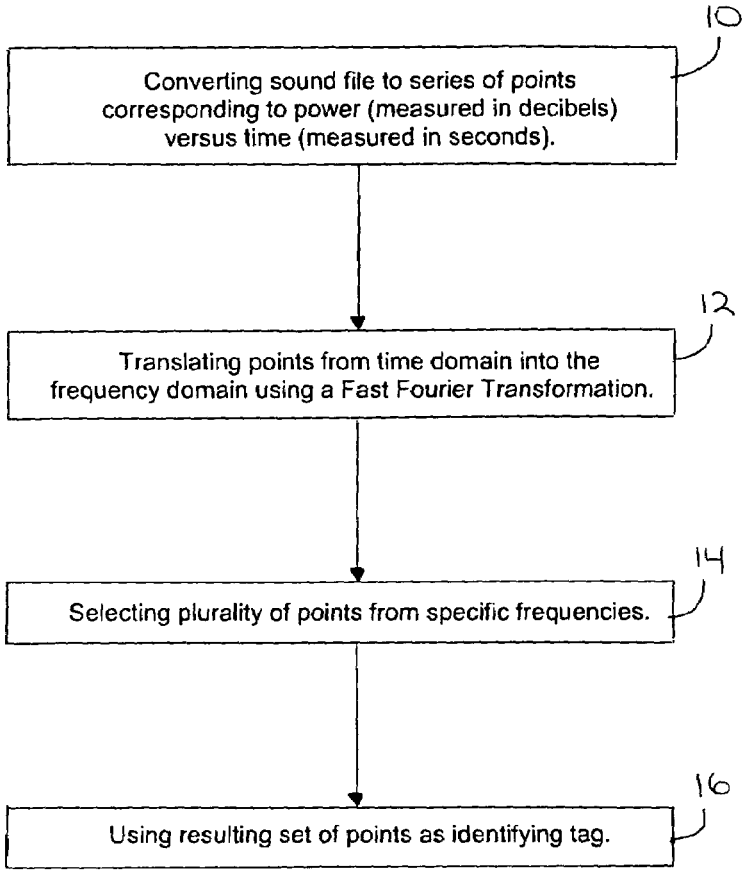

| | | |
|---|---|---|
| 2,1 | 200,10 | 20,100 |

METHOD FOR GENERATING AND ASSIGNING IDENTIFYING TAGS TO SOUND FILES

BACKGROUND OF THE INVENTION

1. Field of the Invention

The present invention is relates broadly to methods and techniques for identifying sound files. More particularly, the present invention concerns a method for generating and assigning an identifying tag to a sound file, wherein the tag is generated using a standard number of chosen points on the sound file's unique frequency domain, thereby facilitating determining the sound file's location, transferring the sound file, and comparing multiple sound files.

2. Description of the Prior Art

It will be appreciated that it is often desirable or necessary to assign identifying tags to sound files to facilitate accurate identification of such files. Currently, this is accomplished either by a user who assigns a tag arbitrarily chosen based upon, for example, a name, date, or description of the sound file, or by a computer that assigns a tag based upon an arbitrarily selected segment of the sound file. Unfortunately, these methods result in subjective and arbitrary identifying tags that do not accurately represent or label the file and that lack of standardization and functionality. Such arbitrary and inaccurate identifying tags can, and do, create situations where two versions of essentially the same sound file are assigned different tags due to the subjective nature of the tagging system. For example, if a computer uses the first 100 bits of a sound file to create an identifying tag for that file, the computer may generate a substantially different identifying tag for a second, virtually identical sound file. This occurs because no consideration is given to oddities in the sound files such as white noise, static, gaps, and poor quality. Such oddities can create slight differences in the chosen 100 bit segment of the sound files and, though the files are otherwise virtually identical, cause the computer to assign different identifying tags.

Additionally, because identifying tags assigned to sound files are not standardized, links are to the sound files are also not standardized. This results in inefficient searching that can return large number of false positives and false negatives that must then be manually searched in order to identify the desired sound file.

Due to the above-identified and other problems and disadvantages in the art, a need exists for an improved method of generating and assigning identifying tags to sound files.

SUMMARY OF THE INVENTION

The present invention provides a distinct advance in the relevant art(s) to overcome the above-described and other problems and disadvantages in the prior art by providing a method for generating and assigning identifying tags to sound files. The present method is distinguished from the prior art method of generating and assigning identifying tags to sound files in that, whereas the current method assigns identifying tags based on arbitrary and subjective criteria, the present method uses standardized criteria to assign the identifying tags. The use of standardized criteria creates a universal system for generating and assigning identifying tags for any sound file.

Practicing the method involves selecting points on the frequency domain of the sound file to generate the identifying tag. This use of the unique frequency domain of each sound file results in a unique identifier for each file while minimizing oddities such as gaps, static, and poor quality in the sound files. Thus, it will be appreciated that the present invention provides substantial advantages over the prior art.

These and other important features of the present invention are more fully described in the section titled DETAILED DESCRIPTION OF A PREFERRED EMBODIMENT, below.

BRIEF DESCRIPTION OF THE DRAWING FIGURES

A preferred embodiment of the present invention is described in detail below with reference to the attached drawing figures, wherein:

FIG. 1 is a flowchart of preferred steps involved in the method of the present invention; and FIG. 2 is a depiction of an identifying sound tag generated by the method of FIG. 1.

DETAILED DESCRIPTION OF A PREFERRED EMBODIMENT

With reference to the figures, a method of generating and assigning an identifying tag for a sound file is herein disclosed in accordance with a preferred embodiment of the present invention. Broadly, the method uses standardized criteria to create the identifying tag for the sound files based upon the sound file's unique frequency domain.

It will be appreciated that, as a general matter, a sound is composed of an infinite summation of smaller component frequencies. Furthermore, the sound can be converted from the standard time domain to its frequency domain. In the frequency domain the sound can be seen as the amplitude of all the different component frequencies. Thus, whereas in the time domain the sound is be measured in power versus time, in the frequency domain the sound is measured in amplitude versus frequency.

The present method of generating and assigning the identifying tag to the sound file is distinguished from well-known prior art methods in that use of the frequency domain eliminates a great deal of subjectivity and arbitrariness. Because each sound file has a unique frequency domain it is used as a sort of fingerprint for the file, applicable only to that sound file. At the same time, however, where sound files are ideally identical but actually contain small oddities that would result, using the prior art methods, in a separate identification, translation to the frequency domain substantially minimizes those oddities so that sound files that are ideally identical will appear more so.

Referring to FIG. 1, the method of the present invention proceeds as follows. The sound file is first converted to a series of points corresponding to power (measured in decibels) versus time (measured in seconds), as depicted in box 10. The points are then translated from the time domain into the frequency domain using a Fast Fourier Transformation, as depicted in box 12. This translation yields a set of points that represent power versus frequency rather than power versus time. This translation has the beneficial effect of minimizing any oddities in the sound file, such as, for example, white noise, static, poor quality, or gaps, that might otherwise make ideally identical sound files appear substantially different, particularly to an automated searching or cataloging mechanism. Thus, the method of the present invention acts to substantially minimize or eliminate problems encountered when using prior art methods, such as, for example, false positives and false negatives when searching for a particular sound file, or differently-labeled versions of the same sound file. Next, a number of these points from specific frequencies are selected, as depicted in box 14. Increasing the number of points selected increases the effectiveness of the method for generating the identifying tag. Preferably, the same specific frequencies are used for all sound files in order to maintain a desired level of standardization in implementing the method. The resulting set of points is the identifying tag, as depicted in box 16.

For example, as shown in FIG. 2, if a sound file is converted into the frequency domain and three points are chosen, [2 db, 1 Hz] [200 db, 10 Hz] [20 db, 100 Hz], the resulting identifying tag 18 would be 2,1,200,10,20,100. Another, different song file might have an identifying tag of 5,1,110,10,17,100. Note that the specific frequencies of 1 Hz, 10 Hz, and 100 Hz remain constant while the power at each of these frequencies is different for the two songs. As mentioned, increasing the number of points increases the effectiveness of the method to eliminate effects due to oddities. Thus, for example, where two song files have a significant number of identical power versus frequency points, and an insignificant number of differences, then it might be said that these song files are identical but for a small or insignificant number of oddities at the sampling points.

Each sound file's unique tag allows the sound to be though of as a point in N dimensional space where N is the number of points used to create the tag. Thus, it will be appreciated that the generated identifying tags are particularly effective because each sound file is assigned its own unique "position" in N dimensional space based on it's own points. In order to further eliminate oddities or identify similarities or differences in songs, the relative positions of two or more sound files can be compared (using, e.g., the well-known distance formula for determining distance between two points in space). Sound files that are similar or identical would appear closer together, and sound files that are dissimilar would appear more distant.

From the preceding description, it will be appreciated that the method of the present invention provides a number of substantial advantages over prior art methods of generating and assigning identifying tags to sound files, including, for example, that it provides a substantially standardized method of generating the identifying tags that minimizes oddities and facilitates subsequent comparisons of the sound files.

Although the invention has been described with reference to the preferred embodiments, it is noted that equivalents may be employed and substitutions made herein without departing from the scope of the invention as recited in the claims. For example, the method can be extended to substantially any application involving substantially any type of sound files, such as, for example, music files, sonar files, and personal identification files based on bodily sounds (e.g., speech or heart sounds).

Having thus described the preferred embodiment of the invention, what is claimed as new and desired to be protected by Letters Patent includes the following:

The invention claimed is:

1. A method of identifying a sound file, the method comprising the steps of:

(a) determining a frequency domain representation of at least a portion of the sound file;

(b) selecting a plurality of points at at least one predetermined frequency from the frequency domain representation; and (c) generating an identifying tag for the sound file based upon the selected points, wherein the selected points are represented as spatial coordinates such that the sound file is identified by its position in space.

2. A method of identifying and comparing sound files, the method comprising the steps of:

(a) determining a first frequency domain representation of at least a portion of a first sound file;

(b) selecting a plurality of first points at at least one frequency from the first frequency domain representation;

(d) generating a first identifying tag for the first sound file based upon the selected first points, wherein the selected points are represented as a first set of spatial coordinates such that the first sound file is identified by its position in space;

(c) determining a second frequency domain representation of at least a portion of a second sound file;

(d) selecting a plurality of second points at the at least one frequency from the second frequency domain representation;

(e) generating a second identifying tag for the second sound file based upon the selected second points, wherein the selected points are represented as a second set of spatial coordinates such that the second sound file is identified by its position in space; and (f) comparing the relative positions of the first and second sets of spatial coordinates in space to determine a degree of similarity between the first and second sound files.

3. The method as set forth in claim 2, wherein the step of comparing the first set of spatial coordinates to the second set of spatial coordinates involves determining a degree of distance between the first points and the second points.

4. The method as set forth in claim 2, wherein, in comparing the first set of spatial coordinates to the second set of spatial coordinates, a total number of differences that do not exceed a pre-established threshold are ignored as oddities.

5. A method of identifying a sound file, the method comprising the steps of:

(a) determining a time domain representation of at least a portion of the sound file;

(b) translating the time domain representation to a frequency domain representation;

(c) selecting a plurality of points at at least one predetermined frequency from the frequency domain representation; and (d) generating an identifying tag for the sound file based upon the selected points, wherein the selected points are represented as spatial coordinates such that the sound file is identified by its position in space.

6. The method as set forth in claim 5, wherein the time domain representation includes time and amplitude, and wherein the frequency domain representation includes amplitude and frequency.

* * * * *